US007919934B2

(12) United States Patent
Lin

(10) Patent No.: US 7,919,934 B2
(45) Date of Patent: Apr. 5, 2011

(54) APPARATUS AND METHOD FOR DRIVING AND ADJUSTING LIGHT

(76) Inventor: Huan-Po Lin, Chong-He (TW)

( * ) Notice: Subject to any disclaimer, the term of this patent is extended or adjusted under 35 U.S.C. 154(b) by 227 days.

(21) Appl. No.: 12/164,003

(22) Filed: Jun. 28, 2008

(65) Prior Publication Data

US 2009/0322255 A1 Dec. 31, 2009

(51) Int. Cl.
*H05B 37/00* (2006.01)

(52) U.S. Cl. ..... 315/291; 315/246; 315/307

(58) Field of Classification Search ..... 315/291, 315/307, 246, 250
See application file for complete search history.

(56) References Cited

U.S. PATENT DOCUMENTS

2009/0251071 A1* 10/2009 Gater et al. ..... 315/297
* cited by examiner

*Primary Examiner* — David Hung Vu

(57) ABSTRACT

An apparatus and method for driving and adjusting light is provided, applicable to the LED lighting environment. Without the necessity to change the existing wiring and lighting devices, the driving and light adjusting apparatus of the present invention can cooperate with LED driver, by counting the number of switch ON/OFF times, to enable the LED driver to adjust light so that the LED lighting device is capable of light adjustment in addition to lighting.

10 Claims, 6 Drawing Sheets

| D1 | D0 | Vref |
|---|---|---|
| 0 | 0 | 0V |
| 0 | 1 | 1/3 x Vcc |
| 1 | 0 | 2/3 x Vcc |
| 1 | 1 | Vcc |

FIG. 6

APPARATUS AND METHOD FOR DRIVING AND ADJUSTING LIGHT

BACKGROUND OF THE INVENTION

1. Field of the Invention

The present invention generally relates to an apparatus and method for driving and adjusting light, and more specifically to an apparatus and method for driving and adjusting light of light-emitting diode (LED) lighting device, without the necessity to change the existing wiring or the structure of the lighting device, to change the lighting by counting the number of switching ON/OFF times so that the LED driver has the light-adjustment capability and the lighting of the LED lighting device is adjustable.

2. The Prior Arts

As the environmental consciousness increases and the energy consumption awareness becomes an agenda, the LED lighting devices gain popularity because of the superior energy efficiency in comparison with the conventional incandescent lamps and fluorescent lighting devices. Therefore, LED is replacing the conventional incandescent or fluorescent bulbs in many lighting devices. However, while LED is more energy efficient, the existing switches and the lighting devices only allow the ON/OFF options for the LED. In other words, the existing switches and lighting devices do not support light adjustment when using LEDs.

At present, the LED driver design focuses on how the LED driver keeps the LED in stable brightness when the input voltage changes. The disadvantage is that additional control signals are required for LED light adjustment; therefore, with the restrictions of the existing wiring, the structure of lighting device and light adjustment device, it is difficult to provide light adjustment for LED because this may imply re-wiring and purchase of new lighting device and light adjustment device. Therefore, LED lighting device is still unable to replace the existing lighting devices.

As for the current fluorescent lighting device, because the fluorescent tube is not adjustable and allows only ON/OFF states, the light adjustment is achieved by switching on different numbers of fluorescent tubes so as to achieve different brightness. However, the above approach usually leads to non-uniform light distribution. In addition, the above approach is also restricted by the number of the fluorescent tubes and the number of the combinations available on the lighting device. When the fluorescent tube is damaged, the options for light adjustment are further restricted. Hence, it remains an important issue in the LED driver design to replace the existing lighting with the LED without the necessity to change the existing wiring or the structure of the lighting device so that the LED light can be adjusted in addition to the lighting capability.

SUMMARY OF THE INVENTION

The primary objective of the present invention is to provide an apparatus and method for driving and adjusting light, applicable to an LED lighting device so that, without the necessity to change the existing wiring or the structure of the lighting device, the LED light can be adjusted in addition to the lighting capability.

Another objective of the present invention is to provide an apparatus and method for driving and adjusting light, applicable to an LED lighting device so that, without the necessity to change the existing wiring or the structure of the lighting device, the apparatus of the present invention can enable the LED driver to adjust the light by counting the number of switching ON/OFF times; therefore, the LED light can be adjusted to achieve better lighting effect and energy efficiency.

To achieve the above objectives, the present invention provides an apparatus for driving and adjusting light. The apparatus for driving and adjusting light outputs the brightness control signal to the LED driver so that the LED driver has the light adjustment capability and the LED lighting device can be adjusted for different brightness. The apparatus for driving and adjusting light of the present invention cooperates with the LED driver to enable the LED driver to adjust the light by counting the number of switching ON/OFF times; therefore, the LED light can be adjusted to achieve different lighting effect.

The foregoing and other objectives, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in conjunction with the examples and references made to the accompanying drawings, wherein:

FIG. 6 shows a schematic view of the relation of the DC analog signal and flip/flop output.

DETAILED DESCRIPTION OF THE PREFERRED EMBODIMENT

Figure 1:
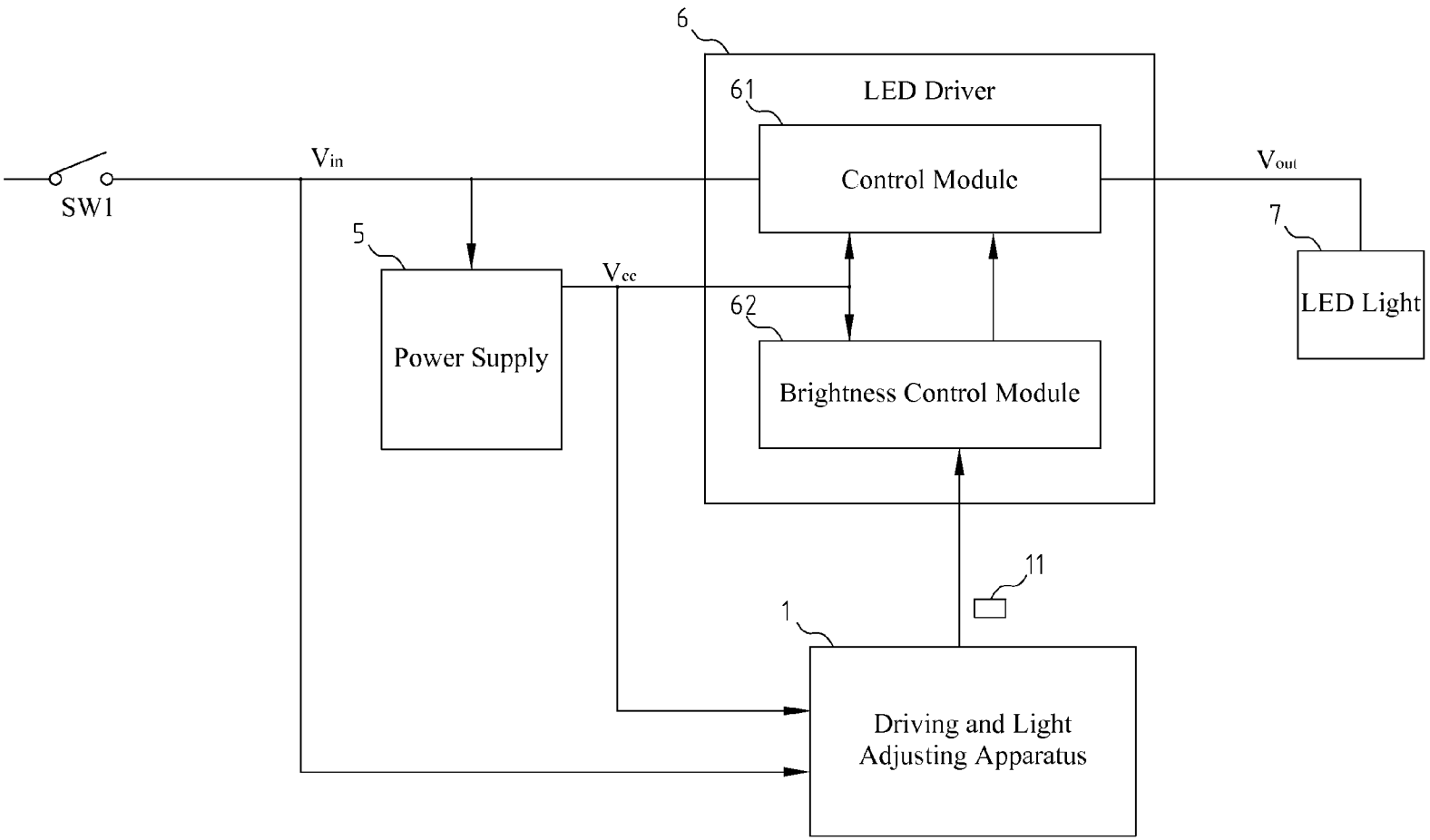
FIG. 1 shows a schematic view of the driving and light adjusting apparatus of the present invention operating with a power supply, an LED driver and an LED light.

FIG. 1 shows a schematic view of the operation of an apparatus for driving and adjusting light of the present invention cooperating with a power supply, an LED driver and an LED light. As shown in FIG. 1, the driving and light adjusting apparatus 1 cooperates with an external power supply 5 and an LED driver 6 so that the LED driver 6 can drives the LED light 7 steadily, where the LED driver 6 includes a control module 61 and a brightness control module 62.

The power supply 5 regulates and filters the input voltage Vin to generate stable output voltage Vcc and provides output voltage Vcc to the driving and light adjusting apparatus 1 and the LED driver 6.

The brightness control module 62 of the LED driver 6 is to adjust the brightness of the LED light. By transmitting pulse width modulation (PWM) or DC signal to the brightness control module 62, the brightness adjustment can be performed. The control module 61 of the LED driver 6 provides output voltage Vout to the LED light 7 so as to drive the LED light 7 steadily.

In FIG. 1, SW1 is the existing lighting device switch; that is, SW1 can be the switch on the wall or on the desk lamp. When SW1 is turned off, the driving and light adjusting apparatus 1 may use the residual power to continue operating for another period. The length of the period depends on the design. If, within this period, SW1 is turned on again, the driving and light adjusting apparatus 1 can count the number of power ON/OFF times of SW1, and according to the counted number of times of SW1 ON/OFF, a different brightness control signal 11 is transmitted to LED driver 6 so as to achieve the objective of controlling brightness of the LED light 7.

Figure 2:
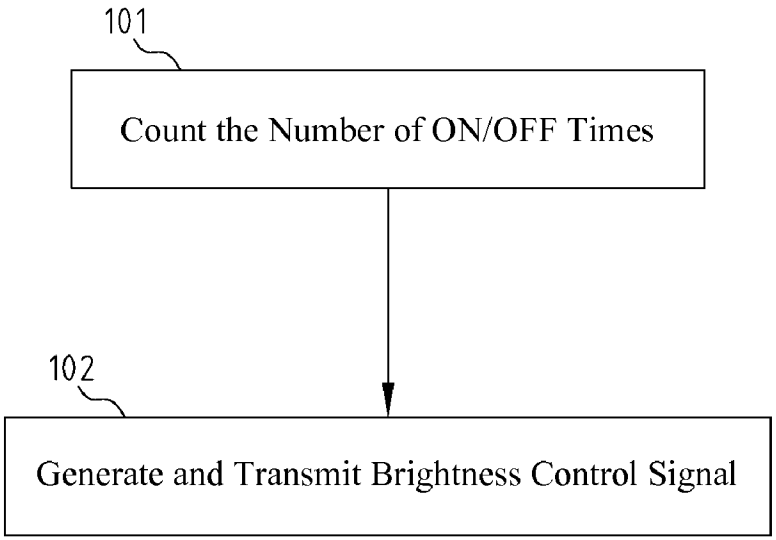
FIG. 2 shows a flowchart of a method for driving and adjusting light using the driving and light adjusting apparatus of the present invention.

FIG. 2 shows a flowchart of the method of using the driving and light adjusting apparatus of the present invention to drive and adjust the light. As shown in FIG. 2, step 101 is to count the number of power ON/OFF times of SW1. Step 102 is for the driving and light adjusting apparatus 1 to generate the brightness control signal 11 in accordance with the number of the SW1 ON/OFF times, and to transmit brightness control signal 11 to the LED driver 6 to enable the LED driver 6 to adjust the brightness of the LED light 7.

Figure 3:
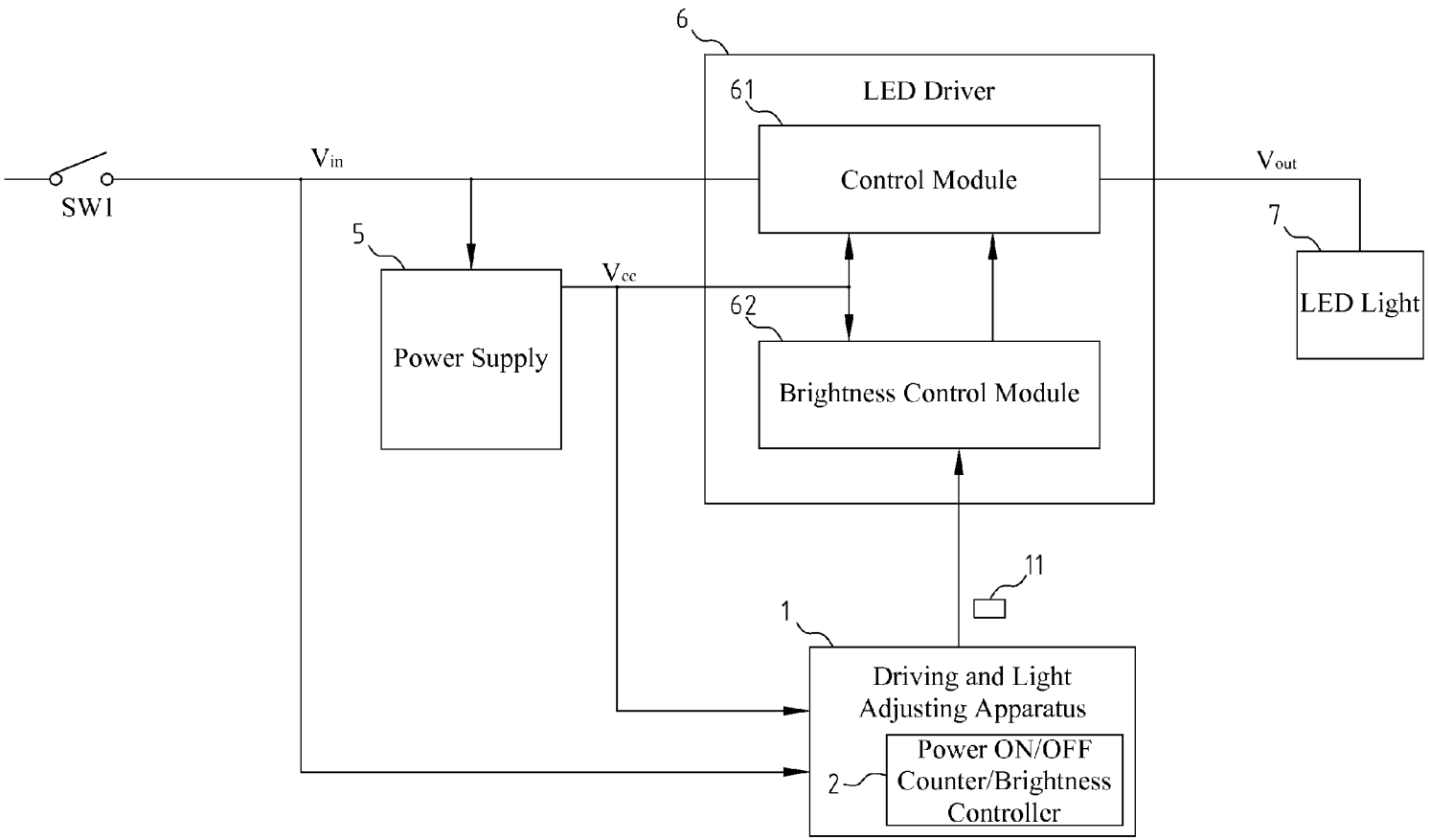
FIG. 3 shows a schematic view of an embodiment of the driving and light adjusting apparatus of the present invention operating with a power supply, an LED driver and an LED light.

FIG. 3 shows a schematic view of the operation of an embodiment of the driving and light adjusting apparatus of the present invention with the power supply and the LED driver. As shown in FIG. 3, the driving and light adjusting apparatus 1, the power supply 5 and the LED driver 6 operate together, where the driving and light adjusting apparatus 1 includes a power ON/OFF counter/brightness controller 2, and the LED driver includes a control module 61 and a brightness control module 62.

The power supply 5 regulates and filters input voltage Vin to generate stable output voltage Vcc, and provides output voltage Vcc to the driving and light adjusting apparatus 1 and the LED driver 6.

The brightness control module 62 of the LED driver 6 is to adjust the brightness of the LED light. By transmitting pulse width modulation (PWM) or DC signal to the brightness control module 62, the brightness adjustment can be performed. The control module 61 of the LED driver 6 provides output voltage Vout to the LED light 7 so as to drive the LED light 7 steadily.

In FIG. 3, SW1 is the existing lighting device switch; that is, SW1 can be the switch on the wall or on the desk lamp. When SW1 is turned off, the driving and light adjusting apparatus 1 may use the residual power to continue operating for another period. The length of the period depends on the design. If, within this period, SW1 is turned on again, the driving and light adjusting apparatus 1 can count the number of power ON/OFF times of SW1, and according to the counted number of times of SW1 ON/OFF, a different brightness control signal 11 is transmitted to the LED driver 6 so as to achieve the objective of controlling the brightness of the LED light 7.

Figure 4:
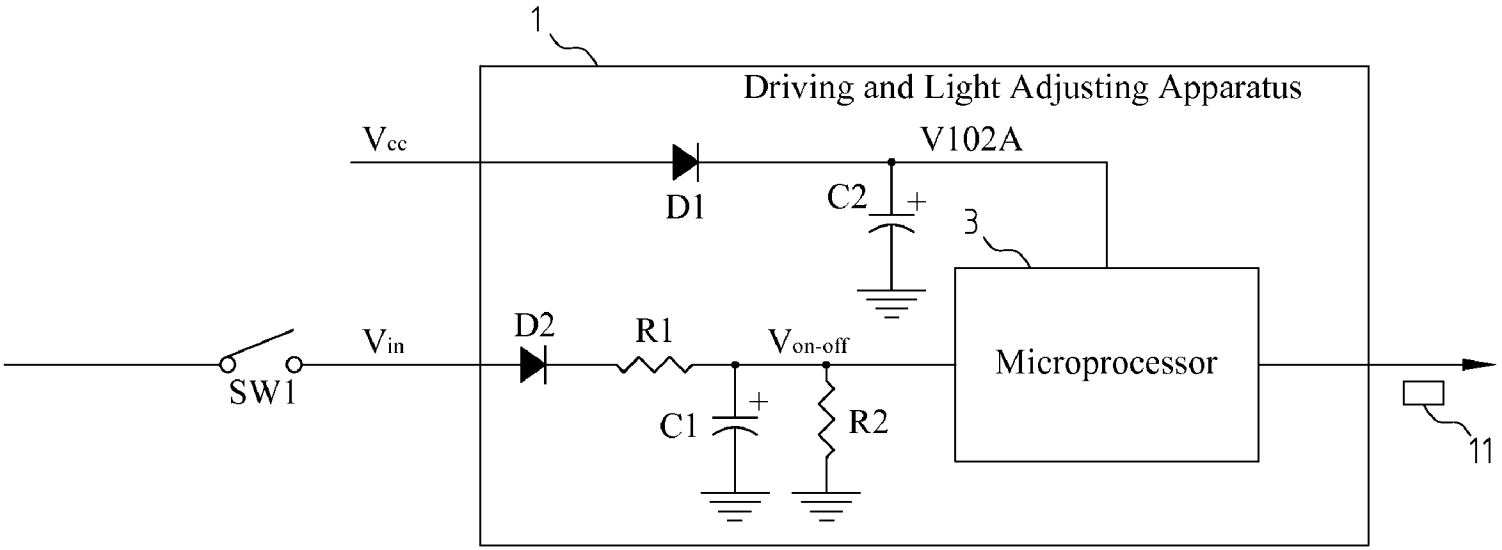
FIG. 4 shows a schematic view of the structure of another embodiment of the driving and light adjusting apparatus of the present invention.

FIG. 4 shows a schematic view of another embodiment of the driving and light adjusting apparatus of the present invention. As shown in FIG. 4, the driving and light adjusting apparatus 1 includes a microprocessor 3, and a plurality of diodes, resistors and capacitors.

A capacitor C2 is responsible for keeping the driving and light adjusting apparatus 1 to operate for another period after SW1 is turned off. A diode D1 is to prevent the power supplied by the capacitor C2 from being consumed by other electronic components.

SW1 is to control the ON/OFF of input voltage Vin. When SW1 is ON, input voltage Vin passes diode D2, resistors R1, R2 and capacitor C1 for regulation, filtering and voltage division to extract Von-off as reference signal. When SW1 is ON, the Von-off is high, and when SW1 is OFF, the Von-off is low.

The microprocessor 3 consists of ASIC, MCU or glue-logic circuit (combination of digital, analog and mix-mode circuit) and is for counting the number of SW1 ON/OFF times. When the power in capacitor C2 is used up, the counter will be reset to zero. According to the number of ON/OFF times, the microprocessor 3 transmits the brightness control signal 11 to the LED driver 6 so that the LED driver 6 can control the brightness of the LED light 7. Depending on the circuit design, the brightness control signal 11 can be an analog signal, PWM or communication interface signal.

Figure 5:
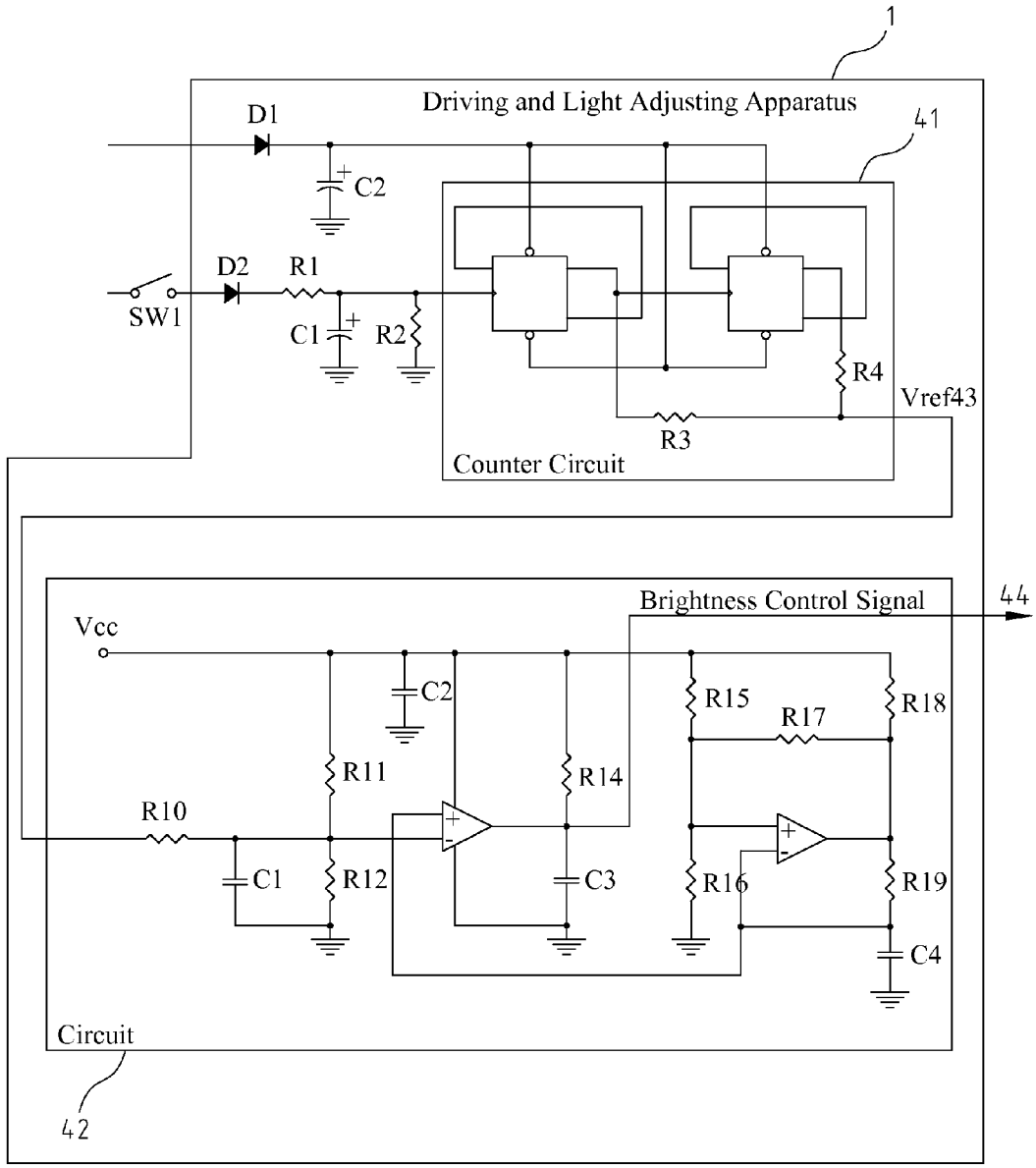
FIG. 5 shows a schematic view of the structure of yet another embodiment of the driving and light adjusting apparatus of the present invention.

FIG. 5 shows a schematic view of yet another embodiment of the driving and light adjusting apparatus of the present invention. As shown in FIG. 5, the driving and light adjusting apparatus 1 includes a counter circuit 41 and a circuit 42, where the counter circuit 41 can be any counter circuit with two or more bits, for example, the counter circuit 41 is a two-bit counter circuit.

The counter circuit 41 (2-bit counter circuit) includes a 2-bit counter made of D flip/flop, JK flip/flop or T flip/flop. For example, the counter circuit 41 is made of D flip/flop, where D1 is the most significant bit (MSB) and D0 is the least significant bit (LSB). A two-bit digital-to-analog converter (DAC) made of resistors R3, R4 can convert the digital output signal from D0 and/or D1 into DC analog signal Vref43, as shown in FIG. 6. FIG. 6 shows the relation between DC analog signal Vref43 and corresponding voltage.

Based on the reference voltage of DC analog signal Vref43, the circuit 42 generates a corresponding brightness control signal 44 and transmits the brightness control signal 44 to the LED driver 6 to control the brightness of the LED light 7.

FIG. 6 shows a schematic view of the relation between DC analog signal and the flip/flop output. As shown in FIG. 6, the DC analog signal Vref43 is represented as Vref. When both D1 and D0 are 0, Vref=0V. When D1 is 0 and D0 is 1, Vref=⅓Vcc. When D1 is 1 and D0 is 0, Vref=⅔Vcc. Finally, when both D1 and D0 are 1, Vref =Vcc.

In summary of the above embodiments, the apparatus and method for driving and adjusting light of the present invention can be applied to LED lighting devices. Without changing the existing wiring and lighting devices, the driving and light adjusting apparatus of the present invention can cooperate with LED driver to count the number of the switch ON/OFF times and change the brightness of the LED light accordingly. The LED driver is capable for light adjustment and the LED light can be adjusted in addition to the lighting capability. In comparison with the existing products, the present invention offers the following advantages:

(1) Saving time and money without changing the current usage manner: by using the existing wiring and lighting devices, the LED lights can be used to replace the conventional fluorescent or incandescent bulbs. The cost of re-wiring or replacement of existing lighting devices is saved.

(2) Capability for brightness adjustment without changing the existing devices, energy-saving and environmentally friendly: Most existing lighting devices do not provide light adjustment capability. The present invention provides a driving and light adjusting apparatus to cooperate with the existing lighting device to add the light adjustment capability to the LED lighting so as to achieve lighting effects as well as save energy.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A method for driving and adjusting light, applicable to an LED lighting environment, without having to change existing wiring and lighting devices, said driving and light adjusting method enabling an LED driver to adjust light so that an LED lighting device is capable of light adjustment in addition to lighting, said method comprising the steps of:

turning an external switch of a driving and light adjusting apparatus ON/OFF a number of times;

using said driving and light adjusting apparatus to count the number of switch ON/OFF times; and according to the counted number of switch ON/OFF times, said driving and light adjusting apparatus generating a corresponding brightness control signal and transmitting said brightness control signal to said LED driver for said LED driver to adjust brightness of LED light of said LED lighting device.

2. The method as claimed in claim 1, wherein said driving and light adjusting apparatus comprises a counter/brightness controller for counting switch ON/OFF times.

3. The method as claimed in claim 1, wherein said driving and adjusting apparatus comprises a microprocessor and a plurality of diodes, resistors and capacitors.

4. The method as claimed in claim 1, wherein said driving and adjusting apparatus comprises a two-bit counter.

5. The method as claimed in claim 3, wherein said microprocessor is an ASIC, MCU or a glue-logic circuit or any combination thereof.

6. A driving and light adjusting apparatus, applicable to an LED lighting environment, without having to change existing wiring and lighting devices, said driving and light adjusting apparatus enabling an LED driver to adjust light so that an LED lighting device is capable of light adjustment in addition to lighting, said apparatus comprising:

an external switch to be turned ON/OFF a number of times;

a counter/brightness controller for counting the number of switch ON/OFF times, generating a corresponding brightness control signal according to the counted number of switch ON/OFF times, and transmitting said brightness control signal to said LED driver to enable said LED driver to control brightness of LED light of said LED lighting device.

7. A driving and light adjusting apparatus, applicable to an LED lighting environment, without having to change existing wiring and lighting devices, said driving and light adjusting apparatus enabling an LED driver to adjust light so that an LED lighting device is capable of light adjustment in addition to lighting, said apparatus comprising:

a plurality of circuit elements, said circuit elements being diodes, resistors and capacitors; and a microprocessor, said microprocessor able to count a number of an external switch ON/OFF times, after said capacitors using up stored power, said counter being reset, and according to the counted number of switch ON/OFF times, generating a corresponding brightness control signal, and transmitting said brightness control signal to said LED driver to enable said LED driver to control brightness of LED light of said LED lighting device.

8. The apparatus as claimed in claim 7, wherein said brightness control signal is an analog signal, PWM or communication interface signal.

9. A driving and light adjusting apparatus, applicable to an LED lighting environment, without having to change existing wiring and lighting devices, said driving and light adjusting apparatus enabling an LED driver to adjust light so that said LED lighting device is capable of light adjustment in addition to lighting, said apparatus comprising:

an external switch to be turned ON/OFF a number of times;

a counter with two or more bits for counting the number of switch ON/OFF times, made of two or more flip/flops;

a digital-to-analog converter converting a digital output signal from said two or more flip/flops into a DC analog signal; and a circuit generating a corresponding PWM brightness control signal according to a voltage level of said DC analog signal, and transmitting said PWM brightness control signal to said LED driver to enable said LED driver to control brightness of LED light of said LED lighting device.

10. The apparatus as claimed in claim 9, wherein said counter with two or more bits is made of a two-bit counter, and said two-bit counter is made of D flip/flop.

* * * * *